US008192215B2

(12) United States Patent
Lin et al.

(10) Patent No.: US 8,192,215 B2
(45) Date of Patent: Jun. 5, 2012

(54) FLAT CABLE CONNECTOR

(75) Inventors: Sung-Tien Lin, Wugu Township, Taipei County (TW); Yen-Lin Chen, Wugu Township, Taipei County (TW)

(73) Assignee: Taiwan Suncagey Industrial Co., Ltd., Wugu Township, Taipei County (TW)

( * ) Notice: Subject to any disclaimer, the term of this patent is extended or adjusted under 35 U.S.C. 154(b) by 0 days.

(21) Appl. No.: 13/290,041

(22) Filed: Nov. 4, 2011

(65) Prior Publication Data

US 2012/0052707 A1 Mar. 1, 2012

Related U.S. Application Data

(63) Continuation-in-part of application No. 12/686,580, filed on Jan. 13, 2010.

(51) Int. Cl.
*H01R 13/15* (2006.01)

(52) U.S. Cl. ..... 439/260

(58) Field of Classification Search ..... 439/260, 439/495, 492

See application file for complete search history.

(56) References Cited

U.S. PATENT DOCUMENTS

| | | | | |
|---|---|---|---|---|
| 7,347,720 | B2 * | 3/2008 | Takashita | 439/495 |
| 2007/0032115 | A1 * | 2/2007 | Takashita | 439/260 |
| 2007/0049087 | A1 * | 3/2007 | Hashimoto et al. | 439/260 |

* cited by examiner

*Primary Examiner* — Tulsidas C Patel
*Assistant Examiner* — Phuongchi Nguyen
(74) *Attorney, Agent, or Firm* — Cheng-Ju Chiang

(57) ABSTRACT

A flat cable connector includes a casing, a plurality of terminals, and a pressing member. Each terminal has a fixing arm, a movable arm, and a connecting portion, the fixing arm having fixing and contact portions, the movable arm having bearing and pressing portions, and a recess formed on the fixing portion and having first and second shoulder portions. The pressing member forms a rotation shaft and a cam portion having a propping end and an actuation end, wherein the rotation shaft is pivotally disposed on the recess, the propping end props against the bearing portion whereby the pressing portion keeps a first distance from the contact portion. When the pressing member is being pressed, the actuation end rotates and props against the bearing portion whereby the pressing portion keeps a second distance from the contact portion, the second distance being shorter than the first distance.

3 Claims, 5 Drawing Sheets

FLAT CABLE CONNECTOR

RELATED APPLICATIONS

This application is a continuation-in-part of U.S. patent application Ser. No. 12/686,580, filed Jan. 13, 2010, priority of the filing date of which is hereby claimed under 35 U.S.C. §120.

BACKGROUND OF THE INVENTION

1. Field of the Invention

The present invention relates to a connector adapted for connecting flexible circuit boards, and more particularly to a flat cable connector having a structure which is firmer and safer.

2. Related Art

A conventional cable connector adapted to connect a flexible circuit board, comprising a case, terminals and a pressing member. When the pressing member is moved, it is capable of operating the terminals to press on the flexible circuit board.

Referring to FIG. 1 showing a schematic view of an implementation of a conventional connector, the conventional connector 1 includes a case 11, terminals 12, and a pressing member 13. Each terminal 12 has a fixed arm 121 and a movable arm 122 spaced apart from the fixed arm 121, both extending in the same direction. The fixed arm 121 is fixed to the case 11. One end of the movable arm 122 is provided with a clamping portion 123, while another end is provided with a portion to be pressed 124. Moreover, the fixed arm 121 is connected to the movable arm 122 by a connecting portion 125 to form a single body, and the pressing member 13 is provided with a cam 131.

When operating the aforementioned structure, a force is to be exerted to move the pressing member 13 to cause it to displace in a predetermined direction, whereby the cam 131 of the pressing member 13 upwardly pushes the portion to be pressed 124. Moreover, the connecting portion 125 is functioned as a pivot to realize angular displacement of the movable arm 122 so as to enable the cam 131 of the pressing member 13 to prop against the portion to be pressed 124 of the movable arm 122, thereby causing the clamping portion 123 to compress downward.

However, the conventional connector has following problems and shortcomings: a gap is formed between the portion to be pressed 124 and the fixed arm 121 prior to the cam 131 of the pressing member 13 pushing the portion to be pressed 124. If a reverse direction force is exerted on the 20 pressing member 13 because of inappropriately operation, the pressing member 13 may break off or be damaged.

Hence, it is the strong desire of the inventor and manufacturers engaged in related art and purpose of the present invention to research, improve and resolve the problems and shortcomings of the aforementioned prior art.

SUMMARY OF THE INVENTION

Accordingly, an object of the present invention is to provide a flat cable connector having a structure which is firmer and safer.

In order to achieve the above-mentioned object, a flat cable connector of the present invention comprises a casing having an upper longitudinal wall, a lower longitudinal wall opposite to the upper longitudinal wall, a left wall and a right wall opposite to the left wall, a central connecting portion disposed between the upper and lower longitudinal walls and the left and right walls, an insertion opening, and an assembling opening, the insertion opening defined at one side of the upper and lower longitudinal walls, the assembling opening defined on the upper longitudinal wall and being opposite to the insertion opening, the upper and lower longitudinal walls cooperatively forming a plurality of terminal passageways; a plurality of terminals received in respect terminal passageways, each of the terminals having a fixing arm, a movable arm, and a connecting portion connecting the fixing arm and the movable arm, wherein the fixing arm is disposed on the lower longitudinal wall, the fixing arm having a fixing portion at one side thereof at the assembling opening, a contact portion at the other side of the fixing arm at the insertion opening, and a recess formed on the fixing portion and having first and second shoulder portions, the contact portion having an interference element formed adjacent to the connecting portion, the movable arm disposed adjacent to and below the upper longitudinal wall, the movable arm having a bearing portion at one side thereof at the assembling opening, and a pressing portion at the other side thereof at the insertion opening; and a pressing member rotatably disposed in the assembling opening and integrally forming a rotation shaft and a cam portion, and a gap portion with respect to the terminal passageways, the cam portion having a propping end and an actuation end, wherein the rotation shaft is pivotally disposed on the recess of the fixing arm, the propping end props against the bearing portion of the movable arm whereby the pressing portion of the movable arm keeps a first distance from the contact portion of the fixing arm, and when the pressing member is being pressed, the actuation end props against the bearing portion whereby the pressing portion keeps a second distance from the contact portion, the second distance being shorter than the first distance. Accordingly, no matter the terminals are in the open or pressed state, the cam portion is always in contact with the bearing portion, and the rotation shaft is pivotally disposed on the recess, thereby effectively preventing the pressing member from springing out of the terminals in the event that the pressing member is being inappropriately operated.

DESCRIPTION OF THE PREFERRED EMBODIMENTS

In order to achieve the aforementioned objectives and effectiveness, the diagrams depicting the preferred embodiments of the present invention and the detailed description of the characteristics and functions thereof follow, whereby the technological means and structure used in the present invention can be completely understood.

Figure 1:
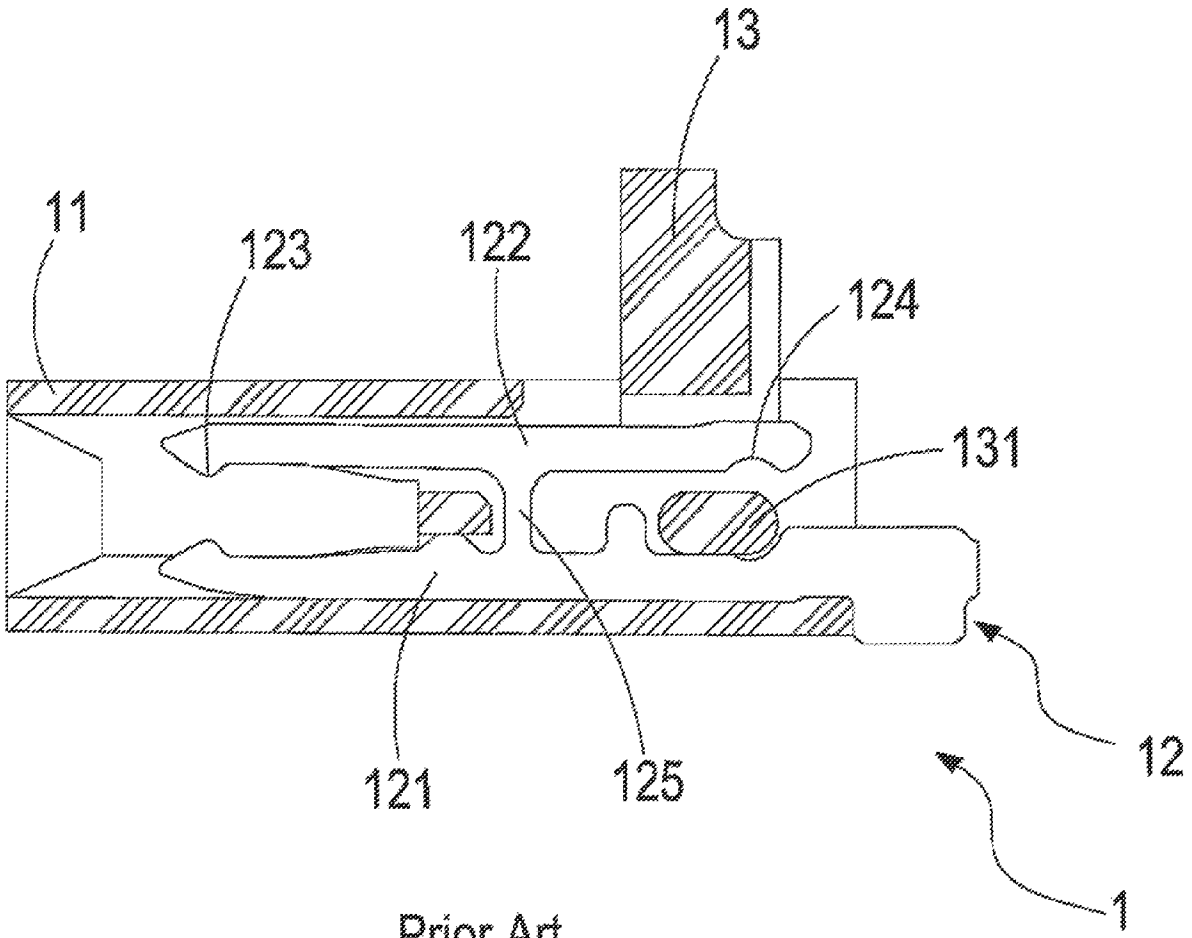
Prior Art FIG.1
FIG. 1 is a schematic view of a conventional connector.
Figure 2:
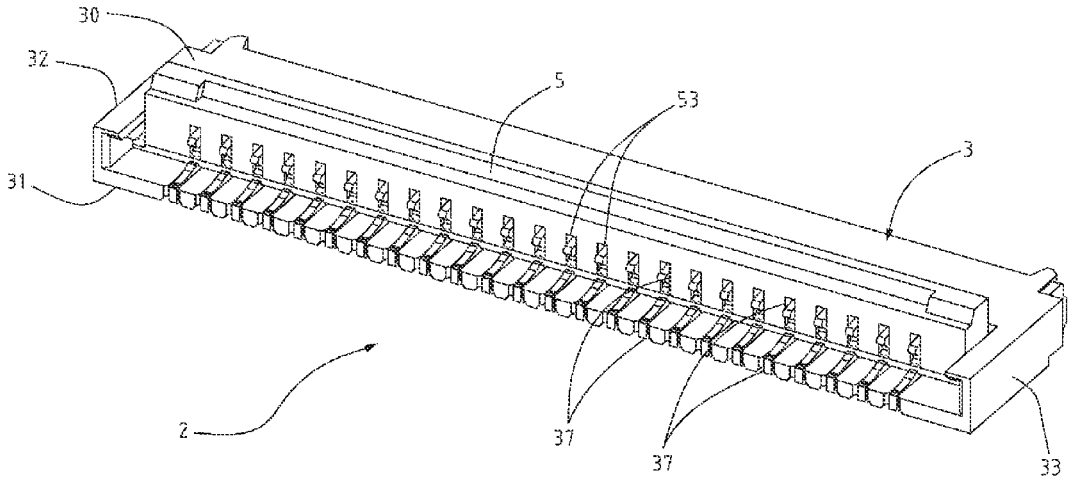
FIG. 2 is a perspective assembly view of a flat cable connector of the present invention.
Figure 3:
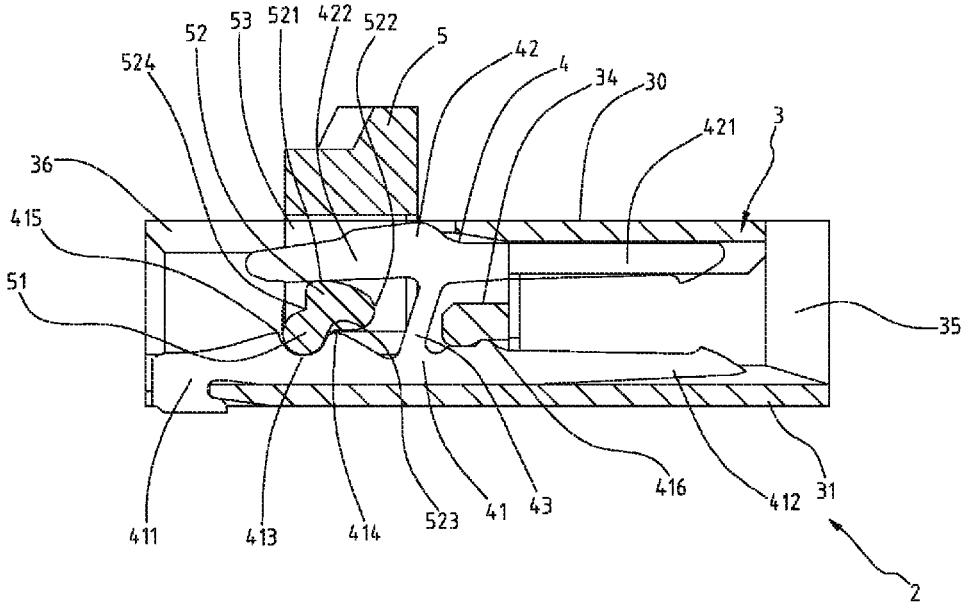
FIG. 3 is a schematic cutaway view of FIG. 2.

Referring to FIGS. 2 and 3 showing a preferred embodiment of a flat cable connector 2 of the present invention. The flat cable connector 2 comprises a casing 3, a plurality of terminals 4, and a pressing member 5. The casing 3 being of a flat rectangle shape and made of dielectric material has an upper longitudinal wall 30, a lower longitudinal wall 40 opposite to the upper longitudinal wall 30, a left wall 32 and a right wall 33 opposite to the left wall 32, a central connecting portion 34 is disposed between and substantially in the middle of the upper and lower longitudinal walls 30, 31 and the left and right walls 32, 33. An insertion opening 35 is defined at one side of the upper and lower longitudinal walls 30, 31, and an assembling opening 36 is defined on the upper longitudinal wall 30 and is opposite to the insertion opening 35 with respect to the central portion 34. The upper and lower longitudinal walls 30, 31 cooperatively form a plurality of terminal passageways 37 in the casing 3.

The plurality of terminals 4, made of metal material, are received in respect terminal passageways 37. Each of the terminals 4 has a fixing arm 41, a movable arm 42, and a connecting portion 43 integrally formed with the fixing arm 41 and the movable arm 42. The fixing arm 41 and the movable arm 42 are spaced apart from each other with the connecting portion 43 connecting therebetween, and the connecting portion 43 is disposed at an angle with respect to either the fixing arm 41 or the movable arm 42 (as shown in FIG. 3). The fixing arm 41 is disposed on the lower longitudinal wall 31 and has a fixing portion 411 at one side thereof at the assembling opening 36, and a contact portion 412 at the other side thereof at the insertion opening 35. A recess 413 is formed on the fixing portion 411 below the movable arm 42 and has first and second shoulder portions 414, 415. The contact portion 412 has an interference element 416 formed adjacent to the connecting portion 43 and protruding out of the contact portion 412. The movable arm 42 is disposed adjacent to and below the upper longitudinal wall 30. The movable arm 42 has a bearing portion 422 at one side thereof at the assembling opening 36, and a pressing portion 421 at the other side thereof at the insertion opening 35.

Figure 4:
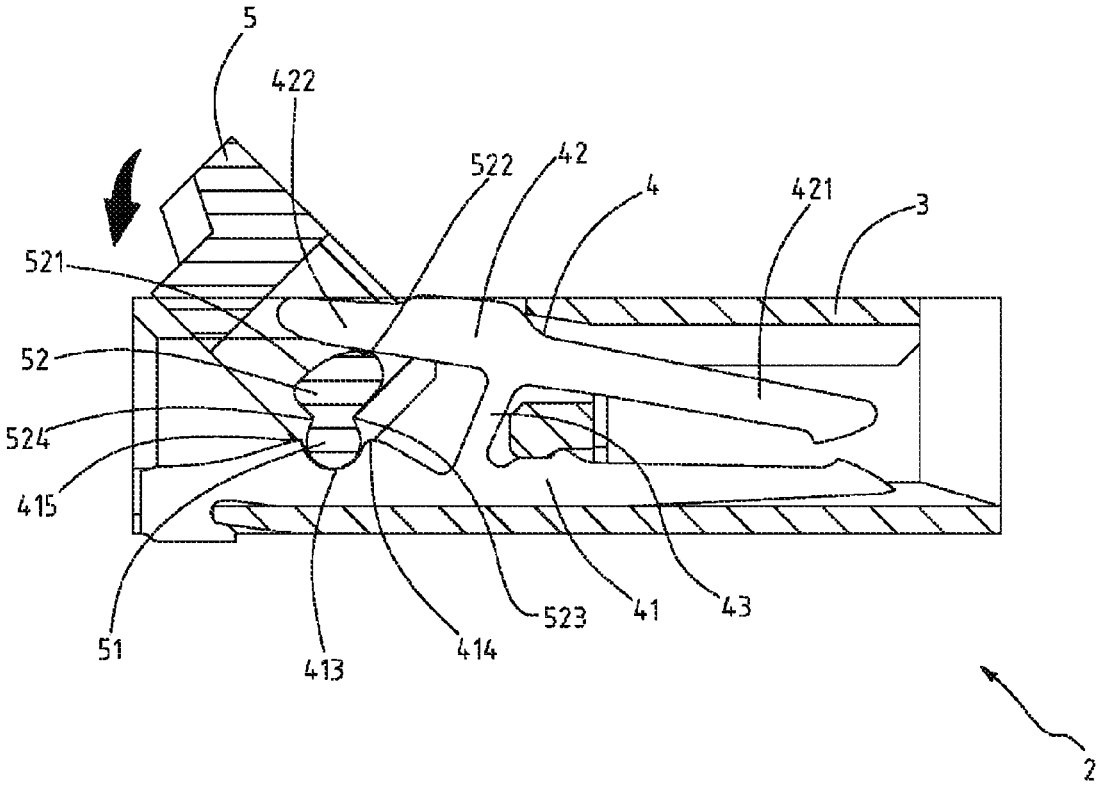
FIG. 4 is a schematic view showing a process of a pressing member of the present invention being rotated.

The pressing member 5 is rotatably disposed in the assembling opening 36 and integrally forms a rotation shaft 51 and a cam portion 52, and a gap portion 53 is formed with respect to the terminal passageways 37. The rotation shaft 51 is pivotally disposed on the recess 413 of the fixing arm 41. The cam portion 52 has a propping end 521 and an actuation end 522, and the size of the cam portion 52 is greater than that of the rotation shaft 51. Junctures of the cam portion 52 and the rotation shaft 51 form first and second engaging portions 523, 524, respectively. The first and second engaging portions 523, 524 are engagable with the first and second shoulder portions, 414, 415, respectively. In assembly, the rotation shaft 51 is pivotally disposed on the recess 413, the propping end 521 props against the bearing portion 422 of the movable arm 52, whereby the pressing portion 421 of the movable arm 42 keeps a first distance from the contact portion 412 of the fixing arm 41 (as shown in FIG. 3). When the pressing member 5 is being pressed, the actuation end 522 props against the bearing portion 422, whereby the pressing portion 421 keeps a second distance from the contact portion 412 (as shown in FIG. 4). The second distance is shorter than the first distance.

Figure 5:
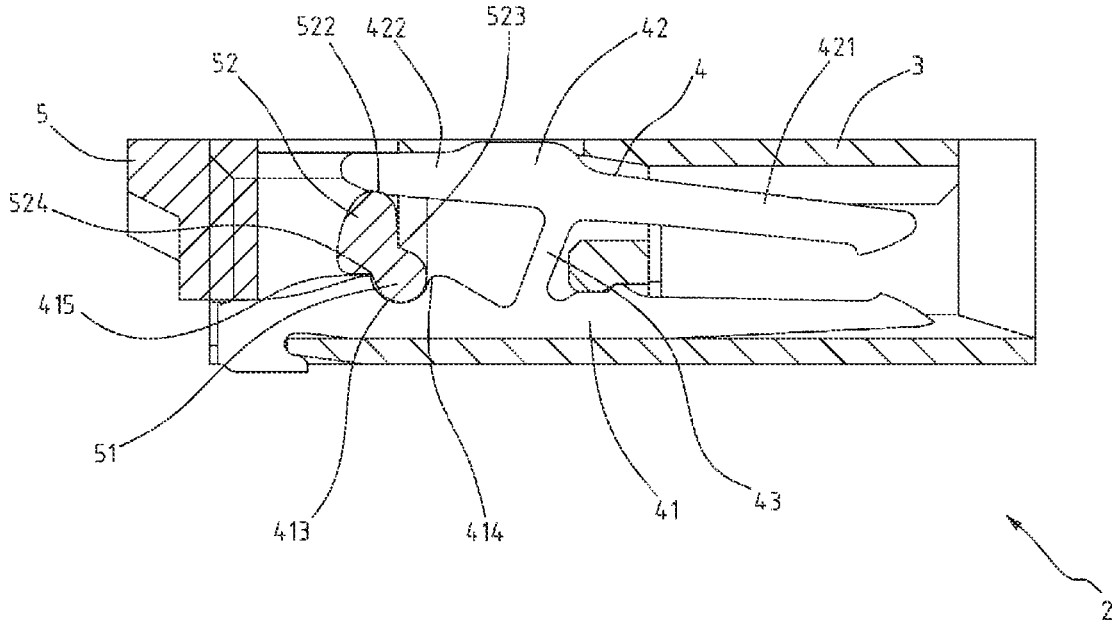
FIG. 5 is a schematic view showing the pressing member of FIG. 4 being rotated in place.

More specifically, the pressing member 5 rotates by being pressed about the rotation shaft 51 to enable the terminals 4 to present an open state and a pressed state. That is, in the open state, the pressing portion 421 keeps the first distance from the contact portion 412 of the fixing arm 41 (as shown in FIG. 3) where the actuation end 522 of the cam portion 52 is located on a side of the first shoulder portion 414 adjacent to the connecting portion 43. In the pressed state, the pressing member 5 is being pressed in place where the pressing portion 421 keeps the second distance from the contact portion 412, the actuation end 522 is located above the first shoulder portion 414 or the second shoulder portion 415 (as shown in FIGS. 4 and 5), and the second distance is smaller than the first distance.

Accordingly, no matter the terminals 4 are in the open or pressed state, the cam portion 52 is always in contact with the bearing portion 422 of the movable arm 42, and the rotation shaft 51 is pivotally disposed on the recess 413, thereby effectively preventing the pressing member 5 from springing out of the terminals 4 in the event that the pressing member 5 is being inappropriately operated.

It is understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A flat cable connector, comprising:

a casing having an upper longitudinal wall, a lower longitudinal wall opposite to the upper longitudinal wall, a left wall and a right wall opposite to the left wall, a central connecting portion disposed between the upper and lower longitudinal walls and the left and right walls, an insertion opening, and an assembling opening, the insertion opening defined at one side of the upper and lower longitudinal walls, the assembling opening defined on the upper longitudinal wall and being opposite to the insertion opening, the upper and lower longitudinal walls cooperatively forming a plurality of terminal passageways;

a plurality of terminals received in respect terminal passageways, each of the terminals having a fixing arm, a movable arm, and a connecting portion connecting the fixing arm and the movable arm, wherein the fixing arm is disposed on the lower longitudinal wall, the fixing arm having a fixing portion at one side thereof at the assembling opening, a contact portion at the other side of the fixing arm at the insertion opening, and a recess formed on the fixing portion and having first and second shoulder portions, the contact portion having an interference element formed adjacent to the connecting portion, the movable arm disposed adjacent to and below the upper longitudinal wall, the movable arm having a bearing portion at one side thereof at the assembling opening, and a pressing portion at the other side thereof at the insertion opening; and a pressing member rotatably disposed in the assembling opening and integrally forming a rotation shaft and a cam portion, and a gap portion with respect to the terminal passageways, the cam portion having a propping end and an actuation end, wherein the rotation shaft is pivotally disposed on the recess of the fixing arm, the propping end props against the bearing portion of the movable arm whereby the pressing portion of the movable arm keeps a first distance from the contact portion of the fixing arm, and when the pressing member is being pressed, the actuation end rotates and props against the bearing portion whereby the pressing portion keeps a second distance from the contact portion, the second distance being shorter than the first distance;

wherein the size of the cam portion is bigger than that of the rotation shaft, junctures of the cam portion and the rotation form first and second engaging portions, respectively, and the first and second engaging portions are engagable with the first and second shoulder portions, respectively;

wherein when the pressing portion keeps the first distance from the contact portion of the fixing arm, the actuation end of the cam portion is located on a side of the first shoulder portion adjacent to the connecting portion.

2. The flat cable connector of claim 1, wherein the first shoulder portion is disposed adjacent to the connecting portion.

3. The flat cable connector of claim 1, wherein when the pressing portion keeps the second distance from the contact portion of the fixing arm, the actuation end of the cam portion is located above the first shoulder portion or the second shoulder portion.

* * * * *